US008712264B2

(12) United States Patent
Okamoto

(10) Patent No.: US 8,712,264 B2
(45) Date of Patent: Apr. 29, 2014

(54) FIXING DEVICE, FIXING DEVICE CONTROL METHOD, AND IMAGE FORMING APPARATUS

(75) Inventor: Masami Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 114 days.

(21) Appl. No.: 13/420,882

(22) Filed: Mar. 15, 2012

(65) Prior Publication Data

US 2012/0237229 A1 Sep. 20, 2012

(30) Foreign Application Priority Data

Mar. 17, 2011 (JP) ..... 2011-059021

(51) Int. Cl.
*G03G 15/00* (2006.01)
*G03G 15/20* (2006.01)

(52) U.S. Cl.
USPC ..... 399/44; 399/69

(58) Field of Classification Search
USPC ..... 399/44, 67, 69, 33
See application file for complete search history.

(56) References Cited

U.S. PATENT DOCUMENTS 6,239,864 B1 5/2001 Okamoto
6,394,446 B1 5/2002 Okamoto
6,411,795 B2 6/2002 Okamoto
7,054,570 B2 5/2006 Kishi et al.
7,092,662 B2 * 8/2006 Yamamura ..... 399/44 X
7,116,923 B2 10/2006 Kishi et al.
7,130,555 B2 10/2006 Kishi et al.
7,209,675 B2 4/2007 Matsusaka et al.
7,212,758 B2 5/2007 Kishi et al.
7,212,759 B2 5/2007 Kishi et a
7,239,821 B2 7/2007 Matsusaka et al.
7,308,216 B2 12/2007 Kishi et al.
7,333,743 B2 2/2008 Kishi et al.
7,343,113 B2 3/2008 Matsusaka et al.
7,356,270 B2 4/2008 Matsusaka et al.
7,359,653 B2 4/2008 Okamoto
7,366,432 B2 4/2008 Kishi et al.
7,373,094 B2 5/2008 Kishi et al.
7,463,841 B2 12/2008 Okamoto
7,496,309 B2 2/2009 Matsusaka et al.
7,515,845 B2 4/2009 Kishi et al.

(Continued)

FOREIGN PATENT DOCUMENTS

JP 2003-076185 A 3/2003
JP 2005-031180 A 2/2005
JP 2007-108695 A 4/2007
JP 2008-129089 A 6/2008

*Primary Examiner* — Sophia S Chen
(74) *Attorney, Agent, or Firm* — Harness, Dickey & Pierce, P.L.C.

(57) ABSTRACT

A fixing device includes a fuser member, a pressure member, a positioning mechanism, an operational thermometer, an environmental sensor, and a controller. The fuser member is subjected to heating. The pressure member is opposite the fuser member. The fuser member and the pressure member press against each other to form a fixing nip therebetween through which a recording medium is passed. The positioning mechanism is coupled with the pressure member to move the pressure member into and away from contact with the fuser member. The operational thermometer adjoins the pressure member to detect an operational temperature at a surface of the pressure member. The environmental sensor is disposed in the image forming apparatus to detect an environmental condition. The controller is connected to the operational thermometer and the environmental sensor to control the positioning mechanism to adjust spacing between the fuser member and the pressure member.

17 Claims, 4 Drawing Sheets

(56) References Cited

U.S. PATENT DOCUMENTS

| | | | | |
|---|---|---|---|---|
| 7,551,869 | B2 | 6/2009 | Kishi et al. | |
| 7,565,087 | B2 | 7/2009 | Matsusaka et al. | |
| 7,603,049 | B2 | 10/2009 | Kishi et al. | |
| 7,609,988 | B2 | 10/2009 | Kishi et al. | |
| 7,664,410 | B2 | 2/2010 | Takagi | |
| 7,683,297 | B2 | 3/2010 | Kishi et al. | |
| 7,885,569 | B2 | 2/2011 | Kishi et al. | |
| 7,957,663 | B2 | 6/2011 | Kishi et al. | |
| 8,023,850 | B2 | 9/2011 | Okamoto et al. | |
| 8,027,627 | B2 | 9/2011 | Okamoto et al. | |
| 8,112,022 | B2 | 2/2012 | Okamoto et al. | |
| 2004/0245241 | A1 | 12/2004 | Kishi et al. | |
| 2004/0247332 | A1 | 12/2004 | Kishi et al. | |
| 2004/0247334 | A1 | 12/2004 | Kishi et al. | |
| 2004/0258426 | A1 | 12/2004 | Kishi et al. | |
| 2005/0123315 | A1 | 6/2005 | Kishi et al. | |
| 2005/0139584 | A1 | 6/2005 | Kishi et al. | |
| 2005/0175368 | A1 | 8/2005 | Matsusaka et al. | |
| 2005/0175370 | A1 | 8/2005 | Matsusaka et al. | |
| 2005/0191078 | A1 | 9/2005 | Kishi et al. | |
| 2005/0220467 | A1* | 10/2005 | Takahashi et al. | 399/67 X |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2006/0133846 | A1 | 6/2006 | Okamoto | |
| 2006/0177232 | A1* | 8/2006 | Ehara et al. | 399/44 |
| 2006/0182460 | A1 | 8/2006 | Kishi et al. | |
| 2006/0237446 | A1 | 10/2006 | Kishi et al. | |
| 2007/0031159 | A1 | 2/2007 | Kishi et al. | |
| 2007/0212090 | A1 | 9/2007 | Matsusaka et al. | |
| 2008/0145088 | A1 | 6/2008 | Matsusaka et al. | |
| 2009/0092409 | A1* | 4/2009 | Chiyoda et al. | 399/67 |
| 2009/0123172 | A1 | 5/2009 | Kishi et al. | |
| 2009/0274477 | A1 | 11/2009 | Okamoto et al. | |
| 2009/0274494 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2009/0317113 | A1 | 12/2009 | Kishi et al. | |
| 2010/0196039 | A1* | 8/2010 | Ono | 399/69 |
| 2011/0085815 | A1 | 4/2011 | Kishi et al. | |
| 2011/0097122 | A1 | 4/2011 | Okamoto | |
| 2011/0222879 | A1 | 9/2011 | Okamoto | |
| 2011/0222891 | A1* | 9/2011 | Kagami | 399/69 |
| 2012/0107002 | A1* | 5/2012 | Nakayama et al. | 399/69 |

* cited by examiner

FIXING DEVICE, FIXING DEVICE CONTROL METHOD, AND IMAGE FORMING APPARATUS

CROSS-REFERENCE TO RELATED APPLICATION

This patent application claims priority pursuant to 35 U.S.C. §119 to Japanese Patent Application No. 2011-059021 filed on Mar. 17, 2011, the entire disclosure of which is hereby incorporated by reference herein.

BACKGROUND OF THE INVENTION

1. Technical Field

The present invention relates to a fixing device, a fixing device control method, and an image forming apparatus, and more particularly, to a fixing device for fixing an image in place on a recording medium, a control method for use in such a fixing device, and an image forming apparatus, such as a photocopier, facsimile machine, printer, plotter, or multifunctional machine incorporating several of those features.

2. Background Art

In image forming apparatuses, such as photocopiers, facsimile machines, printers, plotters, or multifunctional machines incorporating several of those imaging functions, an image is formed by transferring ink or toner onto a recording sheet such as a sheet of paper. The transferred, unfixed toner image may be subsequently subjected to a fixing process using a fixing device, which permanently fixes the toner image in place on the recording medium with heat and pressure.

Various types of fixing devices are employed in electrophotographic image formation. In general, a fixing device includes a combination of rotary fixing members, such as rollers and belts, one being a fuser member subjected to heating, and the other being a pressure member pressed against the heated one to form a fixing nip therebetween, through which a recording medium is conveyed to melt and fuse a toner image in place under heat and pressure as the rotary fixing members rotate together. Typical methods include a roller-based method using a cylindrical fuser roller, and a belt-based method using an endless fuser belt entrained around one or more cylindrical rollers. The fuser member is equipped with a suitable heat source, such as a resistant heating element, a halogen heater, an induction heater, or a magnetic heater, from which heat is supplied to the fixing nip.

To date, several fixing assemblies have been available that employ a positioning mechanism to position the pressure member into and out of contact with the fuser member. The positioning mechanism allows for creating a gap or spacing between the fuser and pressure members during idle or standby where there is no recording medium passing through the fixing device. Once the fixing process is back to normal operation, the spacing is removed by bringing the pressure roller into contact with the fuser member to reestablish the fixing nip.

Provision of spacing or gap between the fuser and pressure members effectively prevents imaging defects, in particular, toner blistering, caused due to overheating of the pressure member. Toner blistering occurs where moisture contained in a recording medium evaporates into vapor bubbles during thermal processing, which eventually form swelling or blisters on a toner image being fixed on the recording medium. The problem is often encountered during duplex printing where a recording medium, having its first surface initially printed and second surface secondly printed, passes through the fixing nip to fix the secondly printed image, while brought into contact with the pressure member that imparts a substantial amount of heat to cause moisture evaporation, resulting in toner blisters on the initially printed image. Toner blistering makes the resulting image appear rough and uneven, which detracts much from imaging quality of the fixing process.

In order to effectively prevent toner blistering with the positioning mechanism, the pressure member is required to be sufficiently spaced apart from the fuser member, so as to isolate the pressure member from thermal influence, i.e., radiation and other forms of heat transfer, from the fuser member, which would otherwise interfere with efficient cooling of the pressure member. To this end, operation of the positioning mechanism may be controlled according to readings of a thermometer measuring temperature on a surface of the pressure member, such that the pressure member do not accumulate excessive heat from the fuser member, as the latter is typically intensively heated during operation.

One problem encountered when using the positioning mechanism is a prolonged first print time required to complete an initial print job upon activation of the image forming apparatus. That is, creating a gap or spacing between the fuser and pressure members necessitates restoring the pressure member into its operational position from non-operational position as the fixing device returns from an idle or standby state. Restoration of the operational position, however, takes a substantial period of delay time, such as on the order of several to more than ten seconds or even longer, depending on driving equipment employed, since the pressure member is required to move gradually and gently toward the fuser member, so as to prevent striking the pressure member against the fuser member, which would otherwise cause undesired vibrations to propagate through neighboring structures, eventually causing adverse effects on the resulting print. This delay, if taking place after a user submits a print job upon activation of the image forming apparatus, can translate into a first print time longer than would otherwise be expected.

SUMMARY OF THE INVENTION

Exemplary aspects of the present invention are put forward in view of the above-described circumstances, and provide a novel fixing device for installation in an image forming apparatus.

In one exemplary embodiment, the fixing device includes a fuser member, a pressure member, a positioning mechanism, an operational thermometer, an environmental sensor, and a controller. The fuser member is subjected to heating. The pressure member is opposite the fuser member. The fuser member and the pressure member press against each other to form a fixing nip therebetween through which a recording medium is passed. The positioning mechanism is coupled with the pressure member to move the pressure member into and away from contact with the fuser member. The operational thermometer adjoins the pressure member to detect an operational temperature at a surface of the pressure member. The environmental sensor is disposed in the image forming apparatus to detect an environmental condition under which the image forming apparatus is installed. The controller is connected to the operational thermometer and the environmental sensor to control the positioning mechanism to adjust spacing between the fuser member and the pressure member according to the operational temperature and the environmental condition being detected.

Other exemplary aspects of the present invention are put forward in view of the above-described circumstances, and provide an image forming apparatus.

Still other exemplary aspects of the present invention are put forward in view of the above-described circumstances, and provide a method for use in a fixing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
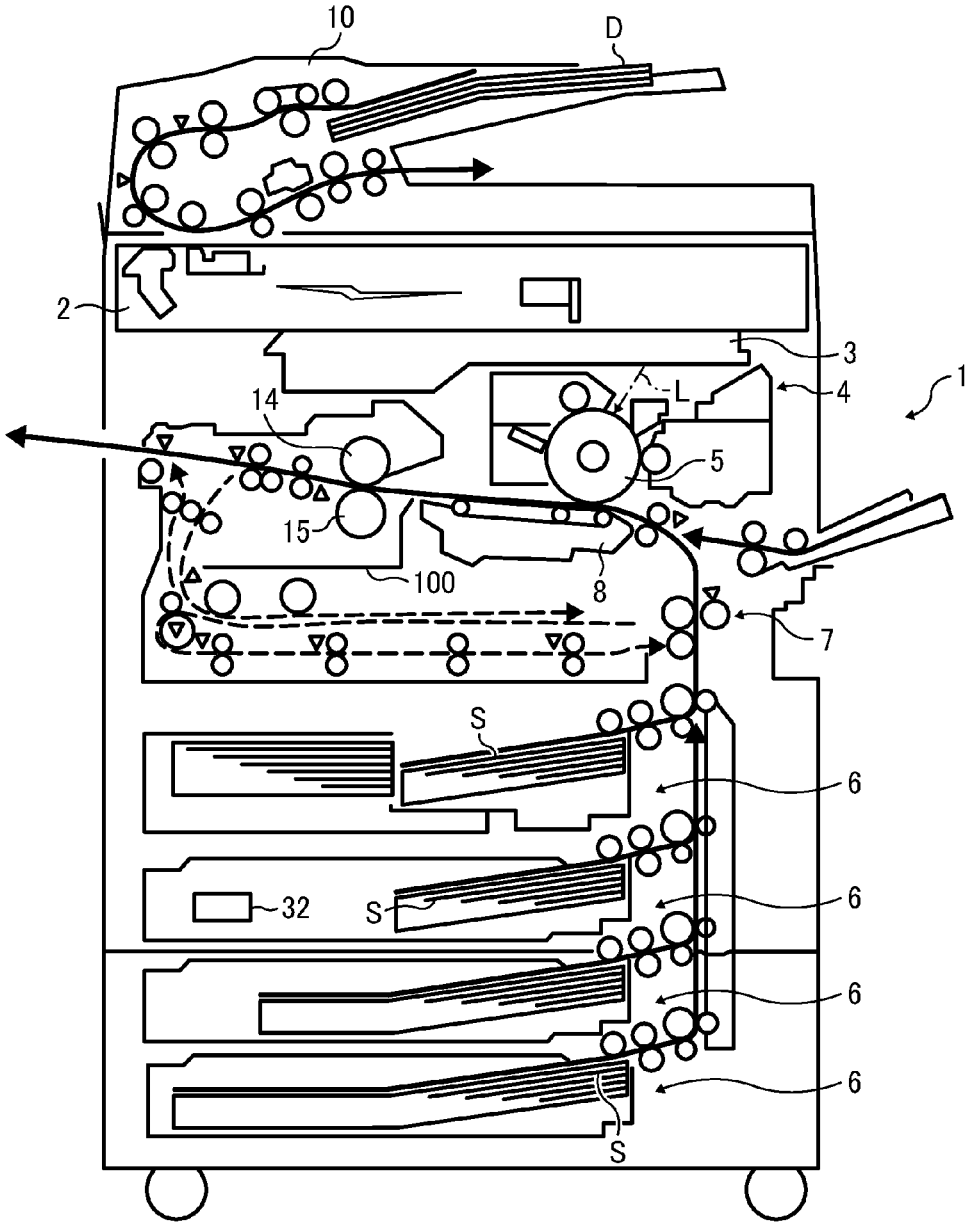
FIG. 1 schematically illustrates an image forming apparatus according one or more embodiments to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 according to one or more embodiments of this patent specification.

As shown in FIG. 1, the image forming apparatus 1 in the present embodiment comprises a photocopier including an image scanner 2 for optically capturing information from an original document D; an exposure device 3 that generates a beam of light, such as a laser beam L, for creating an electrostatic latent image on a photoconductive surface according to the image information output from the image scanner 2; an imaging unit 4 including a drum-shaped photoconductor 5 upon which the electrostatic latent image is developed using toner; a transfer unit 8 for transferring the toner image from the photoconductive surface to a recording medium such as a sheet of paper S; and a fixing device 100 including a pair of opposed, fuser and pressure members 14 and 15, the former internally heated and the latter pressed against the heated one to define a fixing nip N therebetween, through which the recording sheet S is passed to fix the toner image in place.

Also included in the image forming apparatus 1 are an automatic document feeder 10 located above the image scanner 2, which includes multiple feed rollers for automatically feeding a user-input document D for optical scanning; one or more input trays 6 each accommodating a stock of recording sheets S; and a pair of registration rollers 7 and various conveyor members, such as guide plates and rollers, which together define a media conveyance path along which the recording sheet S is conveyed from the input tray 6, through the registration roller pair 7 to the transfer unit 8 and then to the fixing device 100.

During operation, the automatic document feeder 10 rotates the feed rollers to feed an original document D downward toward the image scanner 2. As the document D proceeds, the image scanner 2 scans the surface of the document D with light to obtain image information, which is converted into an electrical data signal for subsequent transmission to the exposure device 3. The exposure device 3 then irradiates the surface of the photoconductor 5 with a laser beam L modulated according to the image data signal.

In the imaging unit 4, the photoconductive drum 5 rotates in a given rotational direction (clockwise in the drawing) to undergo a series of electrophotographic processes, including charging, exposure, and development processes, in which the drum 5 has its outer, photoconductive surface initially charged to a uniform potential, and then exposed to the laser beam L to create an electrostatic latent image thereon, followed by developing the latent image into a visible toner image.

Meanwhile, the media conveyance mechanism picks up an uppermost one of the stacked sheets S in one of the input trays 6 (for example, that situated highest of the four input trays), selected either automatically or manually by the user, and feeds it into the media conveyance path. The fed sheet S first reaches between the pair of registration rollers 13, which hold the incoming sheet S therebetween, and then advance it in sync with the movement of the photoconductive drum 5 toward the transfer device 8, at which the developed toner image is transferred from the photoconductive surface to the recording sheet S.

After transfer, the recording sheet S is introduced into the fixing device 100. In the fixing device 100, the recording sheet S passes through the fixing nip N defined between the fixing members 14 and 15, at which the toner image is fixed in place on the sheet S under heat from the fuser member 14 and pressure between the opposed fixing members 14 and 15. Upon exiting the fixing nip N, the recording sheet S is directed to outside from the apparatus body for user-pickup, which completes one operational cycle of the image forming apparatus 1.

Figure 2A:
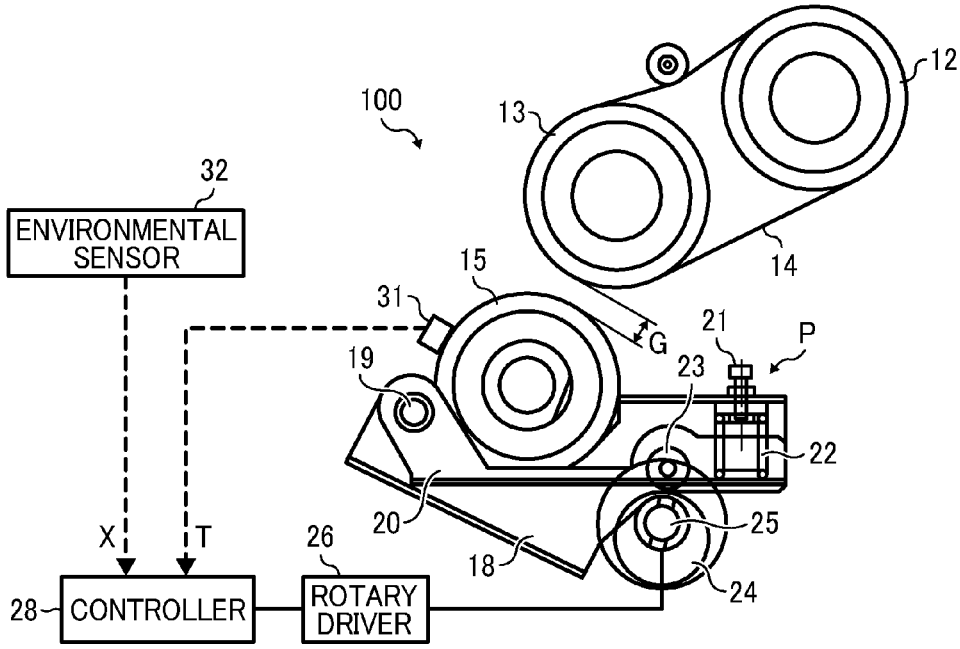
FIGS. 2A and 2B are end-on, axial cutaway views schematically illustrating the fixing device in non-operative and operative states, respectively, according to one or more embodiments of this patent specification.
Figure 2B:
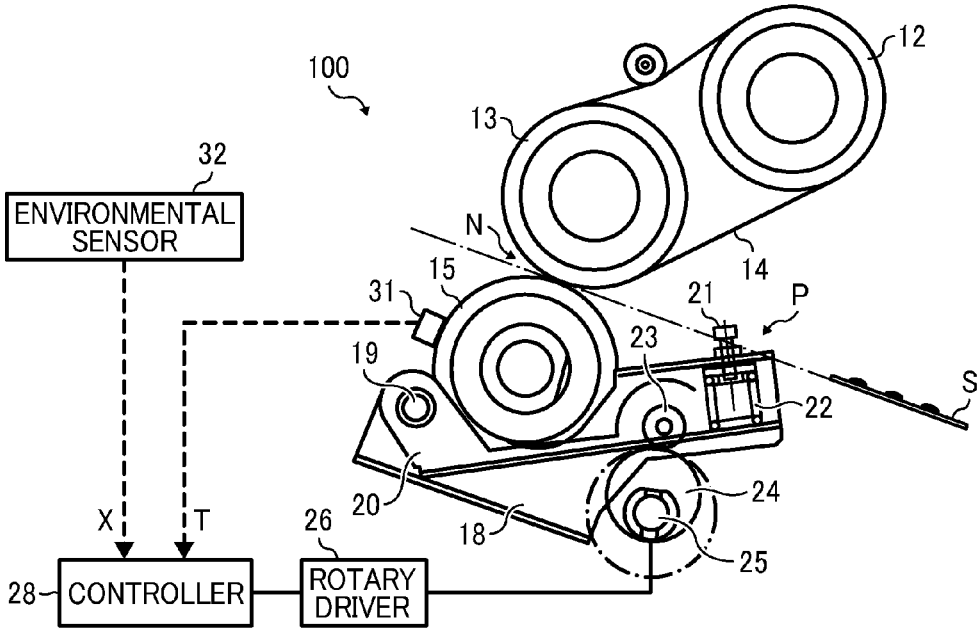

FIGS. 2A and 2B are end-on, axial cutaway views schematically illustrating the fixing device 100 in non-operative and operative states, respectively, according to one or more embodiments of this patent specification.

As shown in FIGS. 2A and 2B, the fixing device 100 includes an internally heated, heat roller 12 provided with a heater; a fuser roller 13 parallel to the heat roller 12; an endless, rotatable fuser belt 14 looped for rotation around the heat roller and the fuser roller 13; and a pressure roller 15 pressed against the fuser roller 13 with the fuser belt 14 disposed between the fuser roller 13 and the pressure roller 15 to form a fixing nip N therebetween where the fixing device 100 is operative.

Components of the fixing device 100 may be enclosed in an enclosure housing or frame for installation in any suitable electrophotographic image forming apparatus, such as that depicted with reference to FIG. 1.

During operation, a recoding medium S bearing an unfixed, powder toner image thereon passes through the fixing device 100. The fuser belt 14 is heated to a desired operational temperature with the heater 12 being controlled, for example, with a feedback heating controller. As the recording medium S is conveyed through the fixing nip N, the toner image is fixed in place with heat from the fuser belt 14 heated by the heat roller 12 and pressure exerted between the fuser and pressure members 13 and 15.

With continued reference to FIGS. 2A and 2B, also included in the fixing device 100 is a positioning mechanism P coupled with the pressure roller 15 to move the pressure roller 15 into and away from contact with the fuser belt 14. Provision of the positioning mechanism P allows the pressure roller 15 to establish its first, non-operational position spaced away from the fuser belt 14 (for example, during idle or standby where there is no recording medium passing through the fixing device 100, as shown in FIG. 2A), and its second, operational position in contact with the fuser belt 14 with an adjustable nip pressure (for example, during operation where a recording medium will pass through the fixing device 100, as shown in FIG. 2B).

In the present embodiment, the positioning mechanism P comprises a motor-driven cam assembly including an eccentric cam 24 rotatable on a drive shaft 25 thereof; a cam follower 23 positioned in contact with the cam 24 to convert rotation of the cam 24 into a displacing force for transmission to the pressure roller 15; and a rotary driver 26 operatively connected to the cam shaft 25 to drive the cam 24 for rotation.

More specifically, the motor-driven cam assembly is connected to the pressure roller 15 through an intermediate, biasing structure including a pin or mandrel 19 connected to the frame of the fixing device 100; an arm 18 with its proximal end hinged to the pin 19, its distal end free, and its intermediate portion defining a curved, bushing surface on which a rotational axis or shaft of the pressure roller 15 is rotatably supported; a swing lever 20 with its proximal end hinged to the pin 19 coaxially with the hinged end of the arm 18 and its distal end affixed to the cam follower 23, such that the cam follower 23 is stationary relative to the lever 20; and an elastic biasing member 22, such as a coil spring, having its one end connected to the distal end of the arm 18 and its another end connected to the distal end of the lever 20, so as to force the arm 18 and the lever 20 away from each other.

Additionally, a tension adjuster 21, such as a screw combined with a lock nut, may be provided to couple the opposed ends of the biasing member 22 to the arm and lever ends, while allowing adjustment of tension on the biasing member 22 where required to adjust nip pressure.

In such a configuration, the positioning mechanism P can move the pressure roller 15 between the non-operational and operational positions as the rotary driver 26 rotates the drive shaft 25 to move the cam 24 between its top dead center (i.e., where the cam follower 23 is nearest to the drive shaft 25, as shown in FIG. 2A) and its bottom dead center (i.e., where the cam follower 23 is furthest from the drive shaft 25, as shown in FIG. 2B).

With specific reference to FIG. 2A, the pressure roller 15 is shown in its first, non-operational position, leaving a gap or spacing G between the surfaces of the fuser and pressure members 14 and 15.

To move the pressure roller 15 from the non-operational position, the rotary driver 26 drives the shaft 25 to rotate the cam 24 from the bottom dead center toward the top dead center, so as to cause the cam follower 23 as well as its connected lever 20 to move farther from the drive shaft 25.

Such movement of the lever 20 is transmitted to the arm 18 via the biasing member 22 connecting the free ends of the arm 18 and the lever 20, which swivels the arm 18 around the shaft 19 to press against the shaft of the pressure roller 15 to in turn displace the pressure roller 15 toward the fuser belt 14. Displacement of the pressure roller 15 with rotation of the cam 24 eventually stops as the roller 15 comes into contact with the fuser belt 14, which is positioned stationary with respect to the frame of the fixing device 100 while rotatable around the belt supporting rollers 12 and 13. At this point, further rotation of the cam 24 causes the biasing member 22 to deform or compress to generate a repulsive force between the free ends of the arm 18 and the lever 19, which is delivered to the shaft of the pressure roller 15 to force the roller 15 against the fuser belt 14 with a proportional biasing force.

As the cam 24 reaches the top dead center, the biasing force exerted to the pressure roller 15 against the fuser belt 14 reaches a certain nip pressure, at which point the pressure roller 15 is now in its second, operational position in contact with the fuser belt 14, as shown in FIG. 2B. Once the operational position is established, the nip pressure may be adjusted to a desired level by adjusting tension on the biasing member 22 with the tension adjuster 21.

Conversely, to move the pressure roller 15 from the operational position, the rotary driver 26 drives the shaft 25 to rotate the cam 24 from the top dead center toward the bottom dead center, so as to cause the cam follower 23 as well as its connected lever 20 to move closer to the drive shaft 25.

Such movement of the lever 20 causes the biasing member 22 to deform or decompress to remove the repulsive force applied between the free ends of the arm 18 and the lever 20. With the biasing member 22 decompressed, further rotation of the cam 24 causes the arm 18 to swivel around the shaft 19 by its own weight and that of the pressure roller 15 to reduce pressure against the shaft of the pressure roller 15 to in turn displace the pressure roller 15 away from the fuser belt 14.

As the cam 24 reaches the bottom dead center, the gap or spacing G between the surfaces of the fuser and pressure members 14 and 15 is maximized, at which point the pressure roller 15 is in its first, non-operational position spaced away from the fuser belt 14, as shown in FIG. 2A.

For simplicity and easy understanding of the positioning mechanism P, the present embodiment describes an example in which the operational position is established with the eccentric cam 24 positioned at the top dead center. Alternatively, however, with the positioning mechanism P described above, it is also possible to obtain a desired nip pressure by adjusting the cam position in any point between the top and bottom dead centers depending on specific configuration of the fixing device.

With still continued reference to FIGS. 2A and 2B, the positioning mechanism P is shown operatively connected with a controller 28 via the rotary driver 26. The controller 28 controls the positioning mechanism 15 to adjust the size of the gap or spacing G between the maximum gap and the minimum or no gap by directing the rotary driver 26 to adjust an angular position or phase of the cam 24, i.e., an amount of rotation of the cam 24 with respect to the top and/or bottom dead centers. Such controller may be configured with any suitable computer or processing device, such as, for example, a central processing unit (CPU) and its associated memory devices for data storage and program execution.

Figure 3:
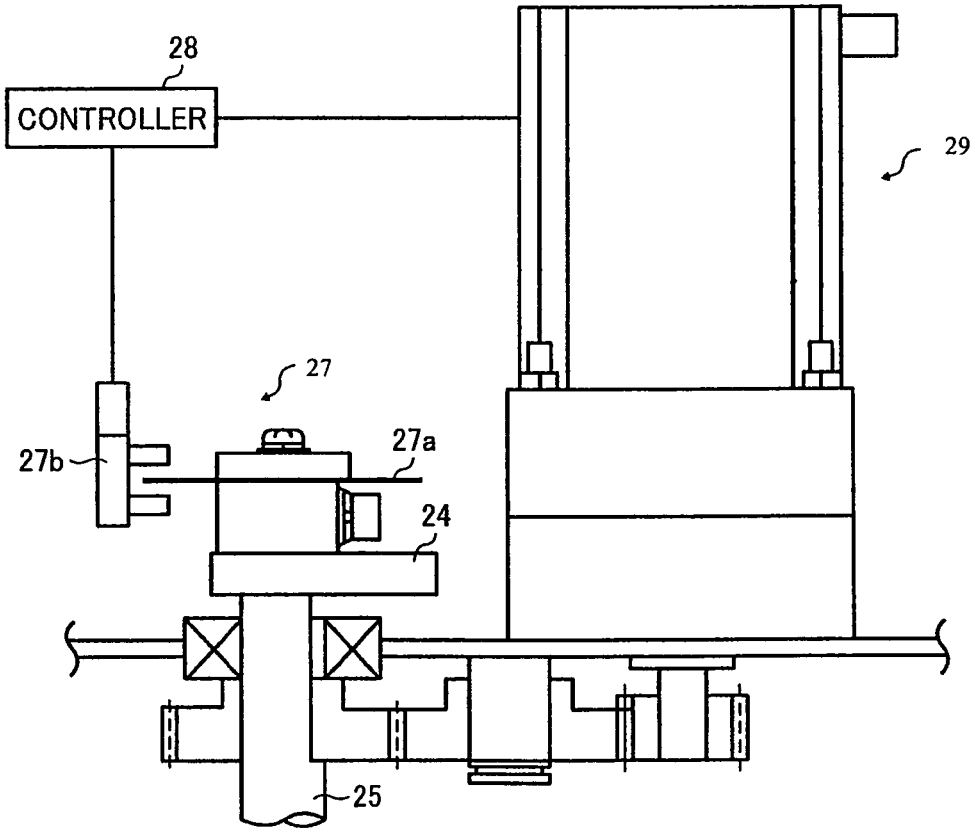
FIG. 3 is an elevational view of an example of a cam rotary driver included in a positioning mechanism of the fixing device of FIGS. 2A and 2B.

FIG. 3 is an elevational view of an example of the cam rotary driver 26 included in the positioning mechanism P.

As shown in FIG. 3, the rotary driver 26 in the present embodiment includes a stepper motor operatively connected to the cam shaft 25 to rotate the cam 24. A phase sensor 27 is provided to rotate in sync with the cam 24 for detecting an angular position or phase of the cam 24, which, in the present embodiment, comprises an optical rotary encoder formed of an encoder disc 27*a* connected to the cam drive shaft 25, and a photodetector 27*b* with a suitable light source. The controller 28 is connected between the stepper motor 29 and the phase sensor 27.

During operation, as the encoder disc 27*a* rotates in sync with the cam 24, the photodetector 27*b* optically measures a rotational position of the disc 27*a* indicating the angular position of the eccentric cam 24. Readings of the sensor 27 are transmitted to the controller 28, which calculates the size of gap G between the fuser belt 14 and the pressure roller 15 based on the cam position detected, and drives the stepper motor 29 to adjust the spacing G to a desired size.

Provision of spacing or gap between the fuser and pressure members effectively prevents imaging defects, in particular, toner blistering, caused due to overheating of the pressure member. Toner blistering occurs where moisture contained in a recording medium evaporates into vapor bubbles during thermal processing, which eventually form swelling or blisters on a toner image being fixed on the recording medium. The problem is often encountered during duplex printing where a recording medium, having its first surface initially printed and second surface secondly printed, passes through the fixing nip to fix the secondly printed image, while brought into contact with the pressure member that imparts a substantial amount of heat to cause moisture evaporation, resulting in toner blisters on the initially printed image. Toner blistering makes the resulting image appear rough and uneven, which detracts much from imaging quality of the fixing process.

In order to effectively prevent toner blistering with the positioning mechanism, the pressure member is required to be sufficiently spaced apart from the fuser member, so as to isolate the pressure member from thermal influence, i.e., radiation and other forms of heat transfer, from the fuser member, which would otherwise interfere with efficient cooling of the pressure member. To this end, operation of the positioning mechanism may be controlled according to readings of a thermometer measuring temperature on a surface of the pressure member, such that the pressure member do not accumulate excessive heat from the fuser member, as the latter is typically intensively heated during operation.

One problem encountered when using the positioning mechanism is a prolonged first print time required to complete an initial print job upon activation of the image forming apparatus. That is, creating a gap or spacing between the fuser and pressure members necessitates restoring the pressure member into its operational position from non-operational position as the fixing device returns from an idle or standby state. Restoration of the operational position, however, takes a substantial period of delay time, such as on the order of several to more than ten seconds or even longer, depending on driving equipment employed, since the pressure member is required to move gradually and gently toward the fuser member, so as to prevent striking the pressure member against the fuser member, which would otherwise cause undesired vibrations to propagate through neighboring structures, eventually causing adverse effects on the resulting print. This delay, if taking place after a user submits a print job upon activation of the image forming apparatus, can translate into a first print time longer than would otherwise be expected.

For example, consider a conventional configuration where the spacing between fuser and pressure members is maximized each time the fixing device moves to its first, non-operational position, so as to create a maximized, large gap between the pressure member and the fuser member to isolate the pressure member from any thermal influence from the hot fuser member. Maximizing the spacing involves moving the eccentric cam from the top dead center to the bottom dead center. Once the spacing is maximized, however, restoring the operational position naturally requires returning the eccentric cam from the bottom dead center to the top dead center, which adds to the first print time required.

The inventors have recognized that the rate of occurrence of toner blisters in a fixing process depends on environmental conditions, in particular, temperature and humidity, under which the image forming apparatus is installed, because these factors dictate an absolute humidity, and hence an amount of moisture contained in a recording medium to be used for printing.

For example, where the environmental temperature is relatively high, a recording medium contains a large amount of moisture due to a relatively high absolute humidity. By contrast, where the environmental temperature is relatively low, a recording medium contains a small amount of moisture due to a relatively low absolute humidity. Since toner blistering results from evaporation of moisture content, the fixing process is more susceptible to toner blisters in the former case than in the latter case. In fact, toner blistering hardly takes place in a dry, cold atmosphere even where the pressure member absorbs a certain amount of heat from the fuser member, insofar as the surface temperature of the pressure member remains below a minimum threshold temperature at which toner blistering occurs irrespective of environmental conditions. In such cases, it is not necessarily required to create a maximized, large gap between the fuser and pressure members to prevent toner blistering at the risk of increasing the first print time, as is the case with the conventional configuration.

To overcome those and other problems of the conventional configuration, the fixing device 100 according to this patent can adjust spacing between the fuser member and the pressure member according to environmental conditions under which the image forming apparatus is installed, so as to effectively prevent thermally induced image defects without unduly increasing the first print time required.

Referring back to FIGS. 2A and 2B, the fixing device 100 is shown further including an operational thermometer 31 disposed on the pressure roller 15 to detect an operational temperature T at the outer circumferential surface of the roller 15 during operation, and an environmental sensor 32 disposed in the image forming apparatus 1 to detect an environmental condition X under which the image forming apparatus is installed.

The controller 28 is connected to the thermometer 31 and the environmental sensor 32 to control the positioning mechanism P to adjust spacing G between the fuser belt 14 and the pressure roller 15 according to the operational temperature T and the environmental condition X being detected.

In the present embodiment, the environmental sensor 32 comprises an environmental thermometer that measures an environmental temperature X at which the image forming apparatus 1 is installed. Alternatively, instead, the environmental sensor 32 may be any type of measuring element indicative of or otherwise used to estimate an absolute humidity of the environment, such as, for example, a hygrometer that measures an environmental humidity at which the image forming apparatus 1 is installed.

The environmental sensor 32 may be located at any suitable position in the image forming apparatus 1, so as to effectively detect an environmental temperature or humidity, indicative of an amount of moisture contained in the recording medium to be used for printing. In the present embodiment, for example, the environmental sensor 32 is located in or adjacent to the input tray 6 in which the recording medium S is accommodated, as shown in FIG. 1.

During operation, the operational and environmental thermometers 31 and 32 measure the operational temperature T and the environmental temperature X, respectively, for transmission to the controller 28. The controller 28 compares the operational temperature T against a defect-inducing threshold temperature Tth−, which represents an operational temperature of the pressure roller 15 capable of inducing image defects, such as toner blistering, due to overheating of the pressure roller 15. The controller 28 also compares the operational temperature T against an operational threshold temperature Tth, higher than the defect-inducing temperature Tth−, and the environmental temperature X against an environmental threshold temperature Xth, so as to adjust the size of spacing G depending on the results of comparison.

Specifically, an environmental temperature X equal to or higher than the environmental threshold Xth indicates that the recording medium contains a relatively high amount of moisture, so that the process is more susceptible to toner blistering. Upon detecting the temperature X equals or exceeds the threshold temperature Xth, the controller 28 creates a greater gap between the fuser belt 14 and the pressure roller 15, which isolates the pressure roller 15 from any thermal influence from the heated belt 14 to allow the roller 15 to cool faster than otherwise possible.

On the other hand, an environmental temperature X lower than the environmental threshold Xth indicates that the recording medium contains a relatively low amount of moisture, so that the process is less susceptible to toner blistering. Upon detecting the temperature X falls below the threshold temperature Xth, the controller 28 creates a smaller gap between the fuser belt 14 and the pressure roller 15, which allows the pressure roller 15 to restore its operational position faster, resulting in a shorter first print time than otherwise possible.

Further, an operational temperature T higher than the operational threshold Tth, which is even higher than the defect-inducing threshold Tth−, indicates that the process is currently most susceptible to toner blistering. Upon detecting the temperature T exceeds the threshold temperature Tth, the controller 28 creates a greater gap between the fuser belt 14 and the pressure roller 15 to accelerate cooling of the pressure roller 15.

On the other hand, an operational temperature T equal to or lower than the operational threshold Tth indicates a reduced susceptibility to toner blistering. Upon detecting the temperature T equals or falls below the threshold temperature Tth, the controller 28 creates a smaller gap between the fuser belt 14 and the pressure roller 15 to shorten the first print time.

More specifically, where the operational temperature T falls below the defect-inducing threshold Tth−, the controller 28 adjusts the spacing G to zero, so that the pressure roller 15 contacts the fuser belt 14 with a desired nip pressure. Such adjustment may not involve actuation of the positioning mechanism P where the fixing nip N has already been established between the fuser and pressure members, in which case the controller 28 simply keeps the pressure roller 15 in its original, operational position.

Where the operational temperature T equals or exceeds the defect-inducing threshold Tth−, the controller 28 then compares the operational temperature T against the operational threshold temperature Tth, and the environmental temperature X against the environmental threshold temperature Xth.

The controller 28 adjusts the spacing G to a first value g1 where the operational temperature T exceeds the operational threshold Tth, and the environmental temperature X equals or exceeds the environmental threshold Xth. The controller 28 adjusts the spacing G to a second value g2, smaller than the first value g1, where the operational temperature T equals or falls below the operational threshold Tth, and the environmental temperature equals or exceeds the environmental threshold Xth. The controller 28 adjusts the spacing G to a third value g3, equal to or smaller than the second value g2, where the operational temperature T exceeds the operational threshold Tth, and the environmental temperature falls below the environmental threshold Xth. The controller 28 adjusts the spacing G to a fourth value g4, smaller than the third value g3, where the operational temperature T equals or falls below the operational threshold Tth, and the environmental temperature X falls below the environmental threshold Xth.

Figure 4:
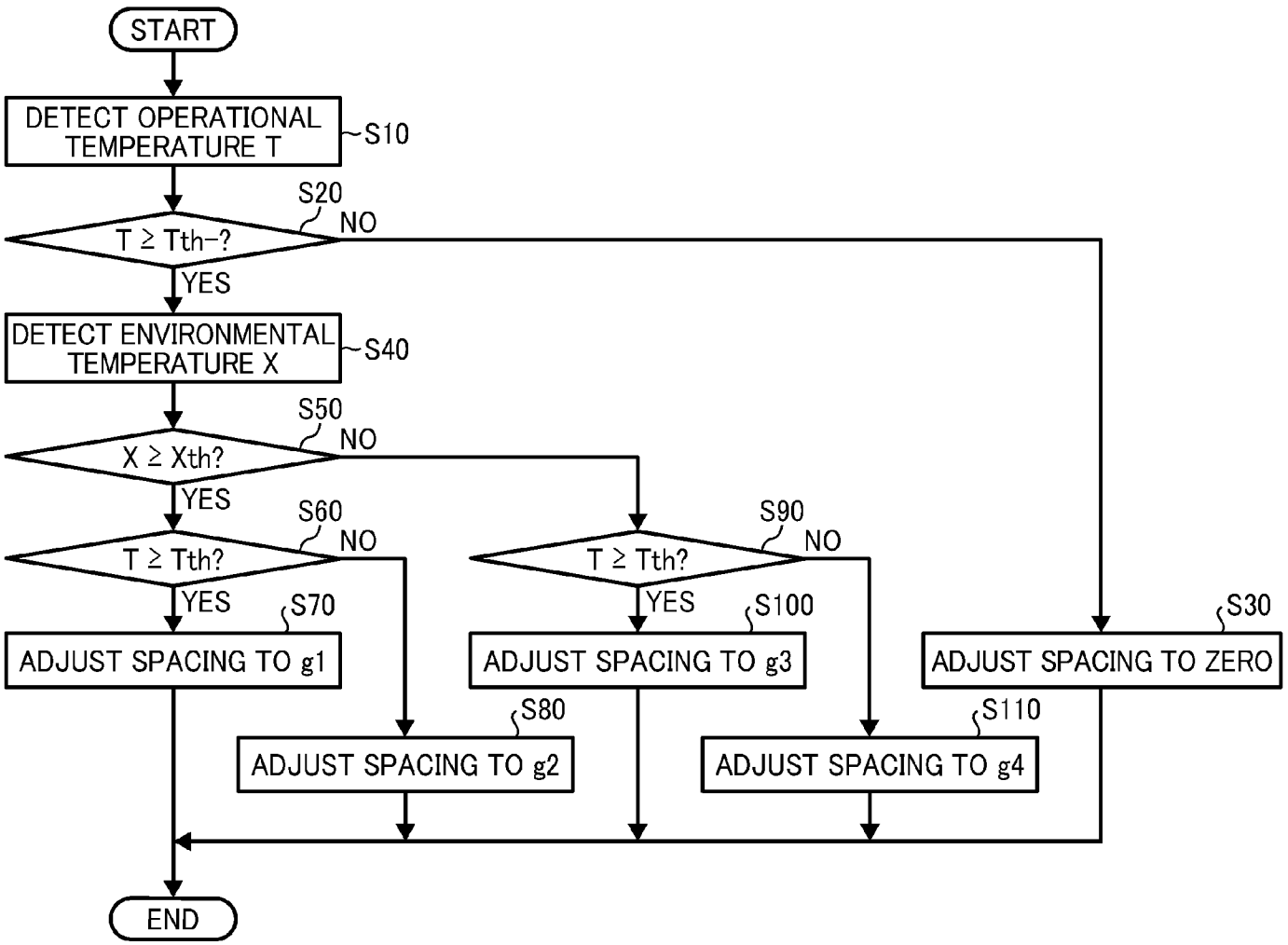
FIG. 4 is a flowchart illustrating operation of a controller adjusting spacing between a fuser belt and a pressure roller in the fixing device of FIGS. 2A and 2B.

FIG. 4 is a flowchart illustrating operation of the controller 28 adjusting the spacing G between the fuser belt 14 and the pressure roller 15.

As shown in FIG. 4, first, in step S10, the operational thermometer 31 detects an operational temperature T at the surface of the pressure roller 15 for transmission to the controller 28.

In step S20, upon receiving the detected temperature T, the controller 28 initially compares the operational temperature T against the defect-inducing threshold temperature Tth−.

Where the operational temperature T falls below the defect-inducing threshold Tth− ("NO" in step S20), the controller 28 adjusts the spacing G to zero in step S30, upon which the operation terminates.

Where the operational temperature T equals or exceeds the defect-inducing threshold Tth− ("YES" in step S20), the environmental thermometer 32 then detects an environmental temperature X in the image forming apparatus for transmission to the controller 28 in step S40.

In step S50, upon receiving the detected temperature X, the controller 28 compares the environmental temperature X against the environmental threshold temperature Xth.

Where the environmental temperature X equals or exceeds the environmental threshold Xth ("YES" in step S50), the controller 28 further compares the operational temperature T against the operational threshold temperature Tth in step S60.

Where the operational temperature T exceeds the operational threshold Tth ("YES" in step S60), the controller 28 adjusts the spacing G to the first value g1 in step S70, upon which the operation terminates.

Where the operational temperature T equals or falls below the operational threshold Tth ("NO" in step S60), the controller 28 adjusts the spacing G to the second value g2 in step S80, upon which the operation terminates.

Where the environmental temperature X falls below the environmental threshold Xth ("NO" in step S50), the controller 28 further compares the operational temperature T against the operational threshold temperature Tth in step S90.

Where the operational temperature T exceeds the operational threshold Tth ("YES" in step S90), the controller 28 adjusts the spacing G to the third value g3 in step S100, upon which the operation terminates.

Where the operational temperature T equals or falls below the operational threshold Tth ("NO" in step S90), the controller 28 adjusts the spacing G to the fourth value g4 in step S110, upon which the operation terminates.

In further embodiment, the operational and environmental thermometers 31 and 32 repeatedly measure the operational and environmental temperatures T and X, respectively, so that the controller 28 readjusts the spacing G upon lapse of a predetermined period of time since previous adjustment of the spacing G.

Specifically, the operational and environmental thermometers 31 and 32 are repeatedly activated whenever the predetermined period of time has elapsed since the controller 28 previously adjusts the spacing G between the fuser belt 14 and the pressure roller 15. Upon activation, the thermometers 31 and 32 detect the operational and environmental temperatures T and X, respectively, for transmission to the controller 28, which accordingly controls the positioning mechanism P to alter or correct the spacing G to conform to the operational and/or environmental conditions currently detected.

For example, where the operational and environmental temperatures T and X as initially measured both exceed the threshold temperatures Tth and Xth, respectively, the spacing G is set to the first gap g1. After lapse of the predetermined period of time, the operational and environmental thermometers 31 and 32 are activated to detect an operational temperature T still higher than the threshold Tth and an environmental temperature X now falling below the threshold Xth. In this case, the spacing G is altered from the first gap g1 to the second value g2, which is more suitable for the environmental condition currently detected.

Thus, with the thermometers 31 and 32 repeatedly activated, the controller 28 can optimize the spacing G for preventing toner blistering without unduly increasing the first print time, even where the operational and/or environmental conditions change over time to cause concomitant variations in susceptibility to toner blistering. This arrangement is particularly effective where there is a prolonged interval between print jobs executed in the image forming apparatus, resulting in a corresponding duration of time during which the fixing device remains idle or standby with no recording medium passing through the fixing nip N.

Hence, the fixing device according to this patent specification can adjust a gap or spacing between the fuser member and the pressure member according to the operational temperature and the environmental condition being detected during, for example, idle or standby where there is no recording medium passing through the fixing device. Setting a relatively small gap between the fuser and pressure members where the image forming apparatus is installed in a relatively cool, dry environment allows for accelerated restoration of the pressure member into its operational position from non-operational position, resulting in a shorter first print time required to complete an initial print job upon activation. Such arrangement does not compromise protection against toner blistering, which occurs depending on the surface temperature of the pressure member, since the fixing process is substantially insusceptible to toner blistering in those environmental conditions where the recording medium contains a sufficiently reduced amount of moisture.

Numerous additional modifications and variations are possible in light of the above teachings. For example, although in several embodiments depicted above, the fixing device is depicted as employing an endless, fuser belt entrained around a fuser roller and a heat roller, alternatively, the fixing device according to this patent specification may be configured as a roller-based assembly that includes a fuser roller, instead of an endless belt, directly heated by a heat source provided in or adjacent to the fuser roller.

Also, although the positioning mechanism is depicted as including a combination of an eccentric cam and a cam follower, alternatively, the fixing device according to this patent specification may be configured employing any type of positioning mechanism, either cam-based or non-cam-based, such as a guide member on which the rotational axis of a pressure roller is displaceably supported.

Further, although the fixing device is depicted in association with a particular type of image forming apparatus, the fixing device and its control method according to this patent specification may be applicable to any type of image forming apparatus, such as a photocopier, facsimile machine, printer, plotter, or multifunctional machine incorporating several of those features.

It is therefore to be understood that, within the scope of the appended claims, the disclosure of this patent specification may be practiced otherwise than as specifically described herein.

What is claimed is:

1. A fixing device for installation in an image forming apparatus, the fixing device comprising:

a fuser member subjected to heating;

a pressure member opposite the fuser member, the fuser member and the pressure member pressing against each other to form a fixing nip therebetween through which a recording medium is passed;

a positioning mechanism coupled with the pressure member to move the pressure member into and away from contact with the fuser member;

an operational thermometer adjoining the pressure member to detect an operational temperature at a surface of the pressure member;

an environmental sensor disposed in the image forming apparatus to detect an environmental condition under which the image forming apparatus is installed; and a controller connected to the operational thermometer and the environmental sensor to control the positioning mechanism to adjust spacing between the fuser member and the pressure member according to the operational temperature and the environmental condition being detected in a state in which a gap is provided between the fuser member and the pressure member.

2. The fixing device according to claim 1, wherein the environmental sensor comprises a thermometer that measures an environmental temperature at which the image forming apparatus is installed.

3. The fixing device according to claim 2, wherein the environmental thermometer is positioned in or adjacent to a media tray in which the recording medium is accommodated.

4. The fixing device according to claim 2, wherein the controller:

compares the operational temperature against an operational threshold temperature and the environmental temperature against an environmental threshold temperature, the spacing being adjusted to a first value where the operational temperature exceeds the operational threshold temperature, and the environmental temperature equals or exceeds the environmental threshold temperature, to a second value, smaller than the first value, where the operational temperature equals or falls below the operational threshold temperature, and the environmental temperature equals or exceeds the environmental threshold temperature, to a third value, equal to or smaller than the second value, where the operational temperature exceeds the operational threshold temperature, and the environmental temperature falls below the environmental threshold temperature, and to a fourth value, smaller than the third value, where the operational temperature equals or falls below the operational threshold temperature, and the environmental temperature falls below the environmental threshold temperature.

5. The fixing device according to claim 4, wherein the controller compares the operational temperature against a defect-inducing threshold temperature, which represents a surface temperature of the pressure member capable of inducing image defects due to overheating of the pressure member, the spacing being adjusted to zero where the operational temperature falls below the defect-inducing threshold temperature.

6. The fixing device according to claim 4, wherein the operational and environmental thermometers repeatedly measure the operational and environmental temperatures, respectively, so that the controller readjusts the spacing upon lapse of a predetermined period of time since previous adjustment of the spacing.

7. The fixing device according to claim 1, wherein the environmental sensor comprises a hygrometer that measures an environmental humidity at which the image forming apparatus is installed.

8. The fixing device according to claim 1, wherein the positioning mechanism includes:

a cam rotatable on a shaft thereof;

a cam follower in contact with the cam to convert rotation of the cam into a displacing force for transmission to the pressure member; and a rotary driver operatively connected to the cam shaft to drive the cam for rotation.

9. The fixing device according to claim 8, wherein the positioning mechanism further includes:

a pin connected to a frame of the fixing device;

an arm with its proximal end hinged to the pin, its distal end free, and its intermediate portion defining a curved, bushing surface on which a rotational axis or shaft of the pressure member is rotatably supported;

a swing lever with its proximal end hinged to the pin coaxially with the hinged end of the arm and its distal end affixed to the cam follower; and an elastic biasing member having its one end connected to the distal end of the arm and its another end connected to the distal end of the lever, so as to force the arm and the lever away from each other.

10. The fixing device according to claim 9, wherein the positioning mechanism further includes:

a tension adjuster connected between the opposed ends of the biasing member to allow adjustment of tension on the biasing member.

11. The fixing device according to claim 8, wherein the positioning mechanism further includes:

a phase sensor rotatable in sync with the cam for detecting an angular position of the cam.

12. The fixing device according to claim 1, wherein the fuser member comprises an endless belt looped for rotation around at least a pair of parallel rollers, at least one of which is internally heated.

13. The fixing device according to claim 1, wherein the fuser member comprises a cylindrical roller provided with a heater.

14. An image forming apparatus, comprising:

an electrophotographic imaging unit to form a toner image on a recording medium; and a fixing device to fix the toner image in place on the recording medium, the fixing device comprising:

a fuser member subjected to heating;

a pressure member opposite the fuser member, the fuser member and the pressure member pressing against each other to form a fixing nip therebetween through which a recording medium is passed;

a positioning mechanism coupled with the pressure member to move the pressure member into and away from contact with the fuser member;

an operational thermometer adjoining the pressure member to detect an operational temperature at a surface of the pressure member;

an environmental sensor disposed in the image forming apparatus to detect an environmental condition under which the image forming apparatus is installed; and a device configured to adjust a spacing between the fuser member and the pressure member according to the operational temperature and the environmental condition being detected in a state in which a gap is provided between the fuser member and the pressure member.

15. A method for positioning a pressure member movable into and away from contact with an opposite, fuser member in a fixing device installed in an image forming apparatus, the method comprising:

detecting an operational temperature at a surface of the pressure member;

detecting an environmental condition under which the image forming apparatus is installed; and adjusting a spacing between the fuser member and the pressure member according to the operational temperature and the environmental condition being detected in a state in which a gap is provided between the fuser member and the pressure member.

16. A fixing device for installation in an image forming apparatus, the fixing device comprising:

a fuser member subjected to heating;

a pressure member opposite the fuser member, the fuser member and the pressure member pressing against each other to form a fixing nip therebetween through which a recording medium is passed;

a positioning mechanism coupled with the pressure member to move the pressure member into and away from contact with the fuser member;

an operational thermometer adjoining the pressure member to detect an operational temperature at a surface of the pressure member;

an environmental sensor disposed in the image forming apparatus to detect an environmental condition under which the image forming apparatus is installed; and a controller connected to the operational thermometer and the environmental sensor to control the positioning mechanism to adjust spacing between the fuser member and the pressure member according to the operational temperature and the environmental condition being detected, wherein the environmental sensor includes a thermometer that measures an environmental temperature at which the image forming apparatus is installed, and wherein the controller:

compares the operational temperature against an operational threshold temperature and the environmental temperature against an environmental threshold temperature, the spacing being adjusted to a first value where the operational temperature exceeds the operational threshold temperature, and the environmental temperature equals or exceeds the environmental threshold temperature, to a second value, smaller than the first value, where the operational temperature equals or falls below the operational threshold temperature, and the environmental temperature equals or exceeds the environmental threshold temperature, to a third value, equal to or smaller than the second value, where the operational temperature exceeds the operational threshold temperature, and the environmental temperature falls below the environmental threshold temperature, and to a fourth value, smaller than the third value, where the operational temperature equals or falls below the operational threshold temperature, and the environmental temperature falls below the environmental threshold temperature.

17. A fixing device for installation in an image forming apparatus, the fixing device comprising:

a fuser member subjected to heating;

a pressure member opposite the fuser member, the fuser member and the pressure member pressing against each other to form a fixing nip therebetween through which a recording medium is passed;

a positioning mechanism coupled with the pressure member to move the pressure member into and away from contact with the fuser member;

an operational thermometer adjoining the pressure member to detect an operational temperature at a surface of the pressure member;

an environmental sensor disposed in the image forming apparatus to detect an environmental condition under which the image forming apparatus is installed; and a controller connected to the operational thermometer and the environmental sensor to control the positioning mechanism to adjust spacing between the fuser member and the pressure member according to the operational temperature and the environmental condition being detected, wherein the positioning mechanism includes:

a cam rotatable on a shaft thereof;

a cam follower in contact with the cam to convert rotation of the cam into a displacing force for transmission to the pressure member; and a rotary driver operatively connected to the cam shaft to drive the cam for rotation, wherein the positioning mechanism further includes:

a pin connected to a frame of the fixing device;

an arm with its proximal end hinged to the pin, its distal end free, and its intermediate portion defining a curved, bushing surface on which a rotational axis or shaft of the pressure member is rotatably supported;

a swing lever with its proximal end hinged to the pin coaxially with the hinged end of the arm and its distal end affixed to the cam follower; and an elastic biasing member having its one end connected to the distal end of the arm and its another end connected to the distal end of the lever, so as to force the arm and the lever away from each other.

* * * * *